US007246830B2

(12) United States Patent
Graves et al.

(10) Patent No.: US 7,246,830 B2
(45) Date of Patent: Jul. 24, 2007

(54) SEALS

(75) Inventors: Daniel Graves, Kent (GB); Chris Benning, Kent (GB)

(73) Assignee: ITW Limited, Berkshire (GB)

( * ) Notice: Subject to any disclaimer, the term of this patent is extended or adjusted under 35 U.S.C. 154(b) by 315 days.

(21) Appl. No.: 10/864,883

(22) Filed: Jun. 10, 2004

(65) Prior Publication Data

US 2005/0001386 A1 Jan. 6, 2005

(30) Foreign Application Priority Data

Jun. 13, 2003 (EP) ..... 0313764

(51) Int. Cl.
*B65D 27/30* (2006.01)
*E05B 39/02* (2006.01)

(52) U.S. Cl. ..... 292/307 R; 292/325; 292/328

(58) Field of Classification Search ..... 292/307 A, 292/307 R, 325, 328; 24/16 PB, 16 R, 30.5 R, 24/30.5 P, 484
See application file for complete search history.

(56) References Cited

U.S. PATENT DOCUMENTS 3,562,870 A 2/1971 Sund
3,588,963 A * 6/1971 Moberg ..... 24/16 PB
3,975,040 A * 8/1976 Van Gompel ..... 292/318
4,328,605 A * 5/1982 Hutchison et al. ..... 24/115 G
4,588,218 A * 5/1986 Guiler et al. ..... 292/307 R
4,626,009 A * 12/1986 Burnett et al. ..... 292/327
4,690,443 A * 9/1987 Brammall ..... 292/307 R
5,056,837 A * 10/1991 Fuehrer ..... 292/307 R
5,568,952 A * 10/1996 Ruegg ..... 292/318
6,174,006 B1 * 1/2001 Burt ..... 292/307 A
6,494,508 B1 * 12/2002 Dreisbach et al. ..... 292/307 R
6,981,725 B2 * 1/2006 Debrody et al. ..... 292/307 R

FOREIGN PATENT DOCUMENTS

| | | |
|---|---|---|
| EP | 0895213 | 2/1999 |
| FR | 2807740 | 10/2001 |
| WO | WO01/54102 | 7/2001 |

* cited by examiner

*Primary Examiner*—Brian E. Glessner
*Assistant Examiner*—Kristina R Gluchowski

(57) ABSTRACT

A seal has a head and a strap, the head having a chamber with an aperture through which the end of the strap can be fed. An arrangement is provided within the chamber to engage the strap so that it cannot be pulled out in the opposite direction to which is inserted. This arrangement includes resilient clip having arms which can flex and overlapping apertured members at the ends of the arms which are configured to provide a variable gap as the strap is pulled through. This clip is mounted in an insert which in turn is fitted in the chamber of the seal.

5 Claims, 3 Drawing Sheets

FIG 1
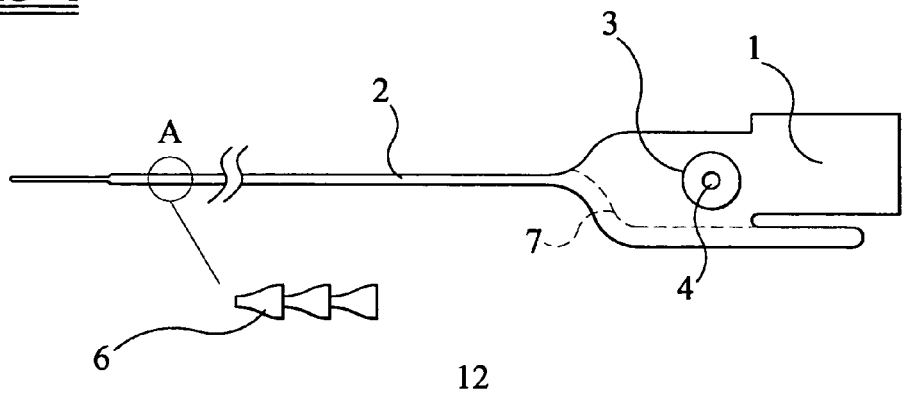
FIG 2
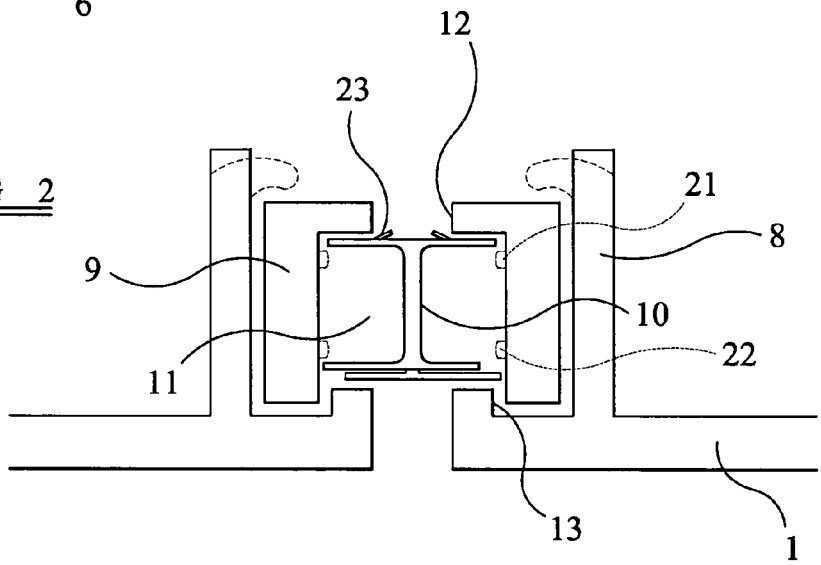
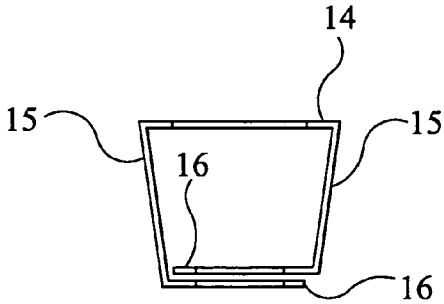
FIG 3a
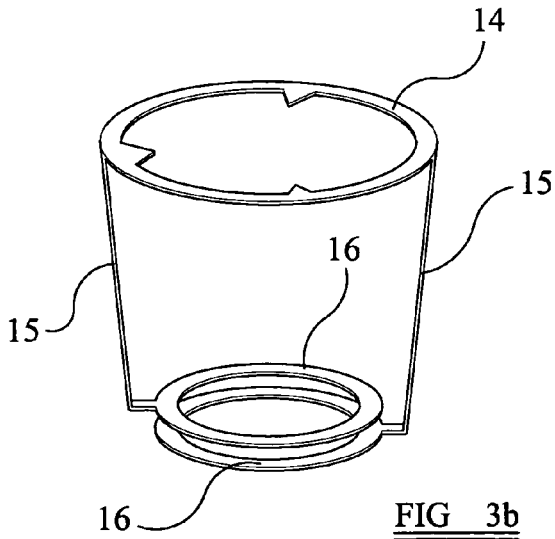
FIG 3b

SEALS

CROSS-REFERENCES TO RELATED APPLICATIONS

This application claims benefit of U.K. Application Serial No. 03 13764.3, filed Jun. 13, 2003, the entire disclosures of which are hereby incorporated by reference.

FIELD OF THE INVENTION

The present invention relates to a seal comprising a head and a strap, the head having a chamber with an aperture through which the end of the strap can be fed, means being provided within the chamber to engage the strap so that it cannot be pulled out in the opposite direction.

BACKGROUND OF THE INVENTION

The strap of this type of seal generally has serrations or teeth formed along its length so that when it is passed through an aperture in the head part it cannot be pulled out. This seal, often known as a 'pull-up seal', provides a tie which can be put around the neck of a bag, and then pulled tight. Because the seal cannot be removed without cutting the tail or separating the head from the tail, the seal provides a tamper evident closure for bags which may contain valuable or sensitive material. Typically, the head part is printed with a unique number, so that one seal cannot be removed and replaced by a fresh seal without this replacement being evident.

Seals with straps which are not serrated are also known. The strap can thus be smooth and the head includes angled teeth or barbs which engage the strap if it is pulled back out of the aperture in the wrong direction.

Pull-up seals are typically used to seal cash bags, property bags and clinical waste bags, but can also be used to lock items other than bags, for example roll cages or tanker valves, to take just two examples.

In a simple version of this type of seal, the seal is moulded as one integral part, the head part having an aperture of specific dimensions which will allow the serrations on the tail to pass through in one direction, but prevent the tail from being pulled out. The serrations are usually formed with an inclined leading edge, so that they can pass under a catch within the head.

In another version of a pull-up seal, the aperture is formed through a separate metal or acetal resin insert which is moulded into a chamber in the head part during the injection moulding of the strap, in other words the chamber is injection moulded around the insert. This provides a seal with a high degree of security, as the locking part within the chamber is not susceptible to tampering. However, this process for manufacturing seals is relatively expensive and difficult to perform reliably.

SUMMARY OF THE INVENTION

The object of the invention is to provide an improved seal which can be manufactured easily and reliably while providing a high degree of security.

According to the invention there is provided a seal comprising a head and a strap, the head having a chamber with an aperture through which the end of the strap can be fed, means being provided within the chamber to engage the strap so that it cannot be pulled out in the opposite direction, the engaging means comprising a separate clip having arms which can flex to provide a variable gap as the strap is pulled through. The arms of the clip extend away from a base and have at their ends engagement portions which extend inwardly and/or laterally to define the gap, the engagement portions engaging behind the serrations on the strap upon its insertion into the head.

The clip may be mounted in an insert which in turn is fitted in the chamber of the seal. The resilient arms of the clip may have overlapping apertured elements at their ends, the degree of overlap providing the variable gap for the strap. The apertured elements can be substantially circular, and preferably the arms are mounted on a circular base with a central aperture.

The insert is preferably substantially cylindrical in shape. The chamber on the head of the seal can also be substantially cylindrical.

The insert may include an engagement rim, lug or recess under which the clip locates, in order to mount the clip within the insert.

The insert can be fitted in the chamber of the seal by ultrasonic welding, or heat sealing, for example melting the top of the chamber over the insert upon its fitting into the chamber.

The invention also provides a seal comprising a head and a strap, the head having a chamber with an aperture through which the end of the strap can be inserted, the chamber including engagement means to engage the strap so that it cannot be pulled out in the opposite direction, wherein the engagement means, for example a toothed element, is mounted in a insert formed of plastics material, this insert being fixed in the chamber of the seal with the engagement means innermost. This provides the advantage that the engagement means are position so that they cannot be tampered with.

The invention further provides a method of forming a seal of the type which has a head part and a strap, the head part having an apertured chamber through which the end of the strap can be inserted in a non-reversible fashion, wherein a clip with engagement means is placed within an insert, the insert is placed in the chamber, and the insert is then fixed within the chamber.

BRIEF DESCRIPTION OF THE DRAWING

Preferred embodiments of the invention will now be described in detail, by example only, with reference to the following drawings, wherein:

FIG. 1 is a plan view of a first embodiment of a seal according to the invention;

FIG. 2 is a part sectional view of the head part of the seal of FIG. 1;

FIGS. 3*a* and 3*b* are side and perspective views showing the clip for use in the strap of FIGS. 1 and 2;

DETAILED DESCRIPTION OF THE INVENTION

Figure 4:
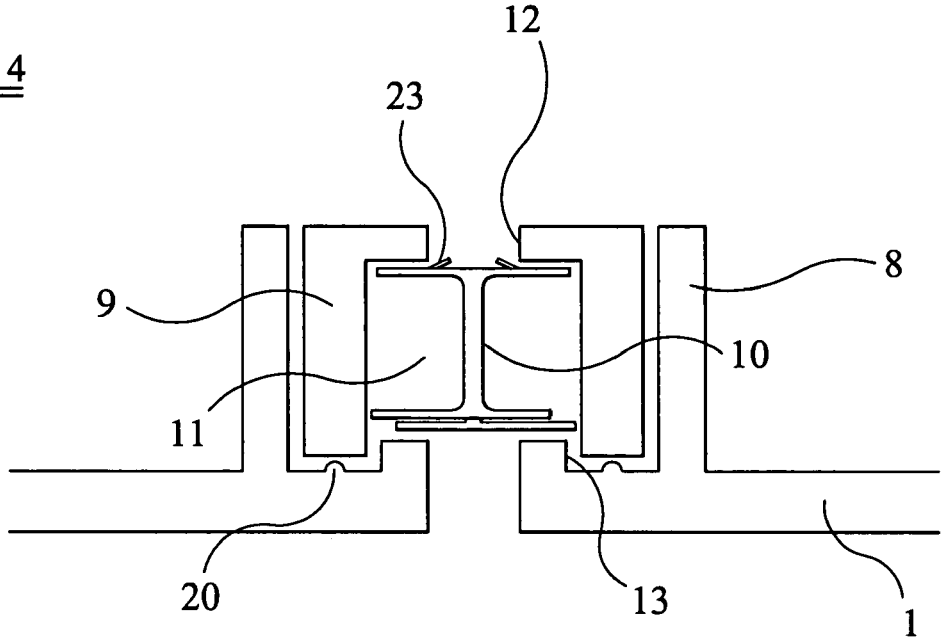
FIG. 4 is a part sectional view, similar to FIG. 2, but showing another embodiment of the head part of the seal.
Figure 5A:
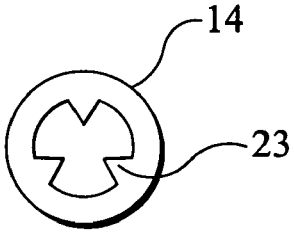
FIG. 5*a, b, c* and *d* are end views showing possible shapes of one end of the clip depicted in FIG. 3*a* and FIG. 3*b;*
Figure 5B:
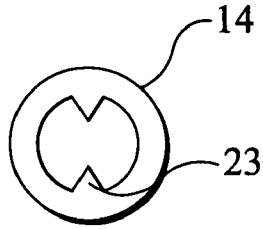
Figure 5C:
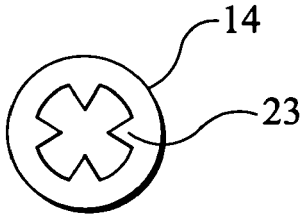
Figure 5D:
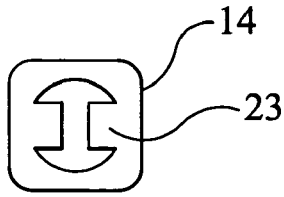

The seal of FIG. 1 includes a head part 1 to which is attached an elongate tail part or strap 2. The head part 1 is flat and on one side and has a raised chamber 3 on the other. The raised chamber 3, in this embodiment, is substantially cylindrical. The chamber 3 has an aperture 4 which extends there through and through which the end of the strap 2 is adapted to be passed. The end of the strap is inserted from the back of the head 1 as shown in FIG. 1.

As indicated by the enlarged detail A in FIG. 1, the strap 2 is formed with a series of frusto-conical shaped serrations 6. Within the chamber, there are engagement means, the geometry and dimensions within the aperture being chosen such that the leading end of the strap 2 with its serrations can go through the engagement means, but the strap cannot then be pulled backwards because of the shape of the serrations 6.

As shown in FIG. 1, the head 1 may be formed with a tear line 7. By this means, the seal can be opened by tearing along the tear line 7 so as to separate the head 1 from the strap 2 where the strap meets the head. Although the strap will still be connected to the head, through the chamber, the strap will no longer form a loop and thus the seal can be removed from the bag (or whatever object it is locking).

The description so far applies equally to a prior art pull-up seal. The present invention differs from the prior art in a surprisingly advantageous fashion through the design within the chamber 3. FIG. 2 shows a sectional view through one example of a chamber suitable for use on the strap of FIG. 1. The head 1 of the strap has integrally moulded thereon a generally cylindrical circular chamber wall 8. Fitted within the wall 8 is an insert 9 and within the insert 9 is a resilient clip 10. As will be described in more detail below, it is the clip 10 which provides the 'non return' feature for these seals, so that the strap can be inserted from below in FIG. 2 but cannot then be pulled out.

The insert 9 is generally cylindrical in shape with a central cylindrical recess 11. The lower end of the insert 9 is open whereas the upper end is formed with a narrow central aperture 12. The head 1 of the seal may be formed with a centering lug 13 to aide fitting of the insert 9.

The insert 9 may be fixed within the chamber walls 8 in a variety of different ways. In the embodiment of FIG. 2, the upper end of the wall 8 is melted over the top of the insert (so as to adopt the position shown in dotted lines), thus reliably locating the insert and clip within the chamber. This provides an inexpensive and reliable way of fitting the insert to the seal.

Although the chamber and insert have so far been described as being substantially cylindrical, it will be understood that other shapes are possible and that the cross section of the chamber and insert need not be circular (e.g. the cross-section could be rectangular). However, if the chamber and insert are circular then the clip may be formed as illustrated in FIG. 3*a* and FIG. 3*b*. As shown in these figures, the clip, which will typically be formed of a metal such as steel, has a ring shaped base 14 from each of two opposing sides of which extends an arm 15. At the end of each arm is formed a similar generally circular clip part or clip ring 16 forming an engagement member to engage the strap. The circular parts 16 are arranged parallel to the circular base 14, but typically are slightly smaller than the base 14 and each may have a slightly smaller central aperture than the aperture of the base.

The arms 15 of the clip 10 are formed so that the apertures of the clip rings 16 do not exactly register. Thus, the aperture which the two clip rings together present in their un-flexed condition is slightly smaller than the aperture which is formed when the rings do register. The aperture formed by the clip rings when they to register is slightly larger than the outer diameter of the serrations 6 of the strap.

Because the arms have a degree of resilience, the leading edges of the serrations 6 of the strap will tend to force the clip rings 16 apart, when the strap is pushed through the chamber of the seal, the clip rings then locating behind each serration. This mechanism for locking the strap into the chamber is very efficient and reliable. Furthermore, because the clip is located within the chamber, with the clip rings inaccessible from outside, a high degree of security is provided to the seal.

It will be appreciated that other designs of resilient clip are possible. It is not essential that the clip is formed of a generally cylindrical shape, though this is convenient. The arms may be formed with differently shaped outer ends or clip parts acting as engagement members (which need not be apertured) provided the ends or clip parts cooperate together to form a gap which can be widened upon insertion of the strap but which will narrow again, because of the resilient construction of the clip, so as to lock the strap into place. For example, each arm of the clip may be "L" shaped, the feet of the "L" shaped arms forming engagement members which flex apart to allow passage of the strap therebetween.

It will be noted that in the clip 10 of FIG. 3, the clip rings 16 overlap one another in a direction perpendicular to a line joining the arms 15, rather than along that line. Thus. When the strap is pulled through the insert in the chamber, the clip rings 16 move so that their apertures register, but the arms 15 themselves do not move apart (they flex sideways). In other designs of the clip, the arms may flex apart.

FIG. 4 is a similar view to FIG. 2, but showing a different way of locating the insert 9 and clip 10 within the chamber wall 8. In this embodiment, it is intended that the insert be fitted to the strap by ultrasonic welding. For this purpose, beads 20 are formed within the chamber wall 8, around the centering ring lug 13, so that the insert can be fixed to the head 1 in a known fashion. The insert may be formed with a rim (not shown) around its top which in practice would overlie the top of the wall 8 of the chamber.

The clip 10 can be fitted within the inserts 9 in a simple fashion, for example by hand. This sort of fitting of the clip is possible because the insert is subsequently fixed to the seal, thus locking the clip into place. For example, the clip can be fitted in the insert by the base part 14 locating behind a ridge 21 within the insert (see FIG. 2). Alternatively, the clip parts 16 could flex on inserting the clip to the insert, so that the clip is located behind a rim 22 (again, see FIG. 2).

Other ways of fitting the clip within the insert are equally possible. For example, the insert may be split along its axis so that the clip can be placed inside and then the two halves of the inserts fitted together. Alternatively, the insert could be open on one side and the clip could be pushed in from the side, located behind a locating ridge. Because the insert is then sealed within the chamber walls, it is not a disadvantage that the insert is open to one side.

As already mentioned, the strap of the seal is to be inserted through the bottom of the head as shown in FIGS. 2 and 4. So as to reduce the possibility of the seal being used incorrectly, with the strap being pushed through the top of the chamber, it is advantageous if the base 14 of the clip has inwardly arranged teeth 23, these teeth being orientated outwardly, away from the clip rings 16. By this means, a user will find it difficult to insert the strap through the top of the chamber. FIG. 5 shows a number of options for the design of the clip. These figures showing embodiments of the clip having two, three or four teeth. It will be understood that these "anti-feed" feature also act to hold the strap in the chamber (together with the clip 10), when the strap is fed in correctly.

Other mechanisms for preventing the strap from being inserted from the wrong side of the head of the seal are possible. For example, the angled teeth could be formed on the aperture 12 of the insert, rather than on the clip (the teeth could be plastic or metal). Alternatively, the aperture of the insert could have a flap which opens only one way, or a baffle which is broken only by insertion of the strap the correct way.

Figure 6:
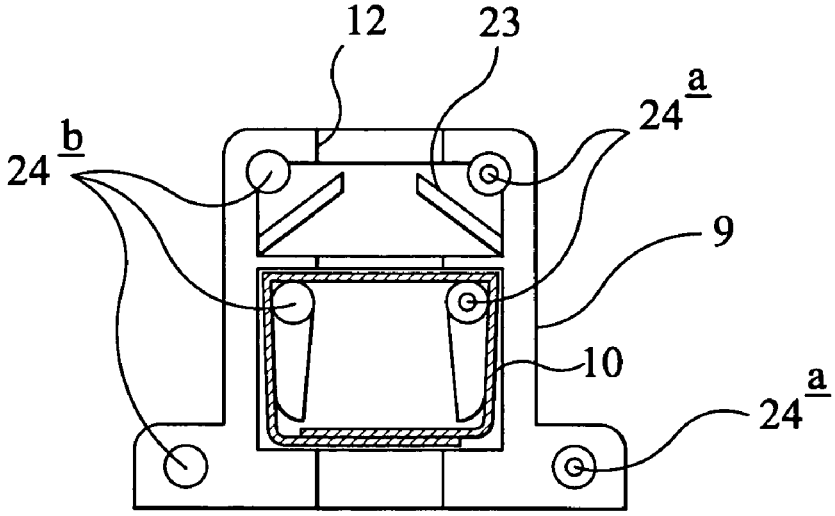
FIG. 6 is a part side view and part sectional view showing another formation of the insert for use in the seal.

A slightly different form of insert is illustrated in FIG. 6. This side view illustrates that the insert 9 is formed in two halves, one half being shown. The two halves are press-fitted together to enclose the clip 10, pins 24*a* on one side of one half engaging in holes 24*b* on the other side of one half. Because the insert is subsequently fixed in the chamber, the two halves to not need to be welded together, so the fitting of the clip and the closing of the insert is a simple hand operation. The clip 10 is shown within the insert, fitted in from the side of one insert-half.

FIG. 6 also shows the angled teeth 23 to prevent insertion of the strap from the wrong direction, these teeth being integrally moulded in the plastic insert just inside aperture 12.

Figure 7A:
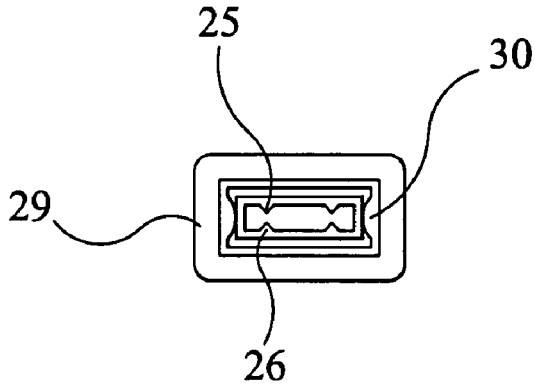
FIGS. 7*a* and 7*b* are plan and side views showing another insert and clip for use in a seal according to the invention.
Figure 7B:
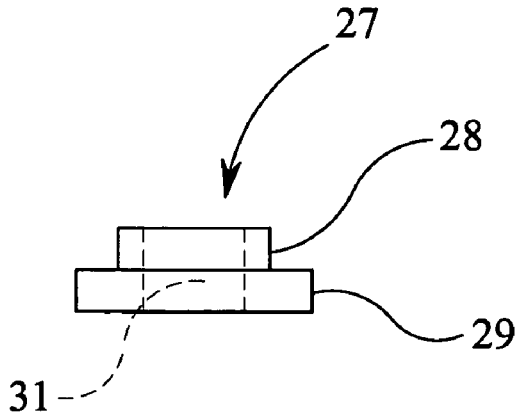

In addition to providing a seal with a new and improved locking mechanism within the chamber, the invention also concerns an improved method of making a seal. In this method, the insert is formed with a clip with engaging means (for example angled teeth), the insert then being fitted within a chamber by welding or heat sealing, or any other known mechanism. For example, an insert with another form of metal clip is illustrated in FIG. 7. In this embodiment, the clip 25 is formed of a generally flat metal plate with at least one tooth 26 on either side. The clip is press-fitted into a recess 27 formed by a wall 28 on a generally rectangular insert 29. The wall has a ridge 30 on either side under which the clip can locate. The insert has an aperture 31 through which the strap can pass, the mouth of the clip registering with this aperture.

The insert is then inserted into the chamber wall (which can be rectangular in plan view, or circular as desired) on the head part of the seal, with the metal clip at the bottom. The insert can then be sealed within the chamber using any known method, for example as discussed above in relation to FIGS. 2 and 4. Because the clip is fitted to the insert in a simple way, and because the mechanism for fixing the insert to the chamber is very simple, this provides a very good and reliable means for forming a seal. The seal also has the advantage that the clip part is located in a secure position, where it cannot easily be tampered with.

The strap and head and chamber parts of the seal will typically be formed of polyethylene or polypropylene, or any other suitable plastic material as would be known to the man skilled in the art.

The invention claimed is:

1. A seal comprising a head and a strap, the head having a chamber with an aperture through which the strap is inserted, the chamber enclosing a clip having a variable aperture comprising overlapping apertured members each having an aperture and each movable with respect to one another, the clip further includes a base opposite the overlapping apertured members wherein each of the overlapping apertures members are supported on respective flexible arms which extend from the base in a direction essentially parallel with the direction in which the strap passes through the clip, whereby an overlap of the apertures, through each of which the strap is inserted, is variable, and, when the apertures in each of the overlapping apertured members are in register, the effective opening for the passage of the strap is greater than when the apertures are out of register.

2. A seal according to claim 1 wherein the clip includes an insertion preventing arrangement which prevents insertion of the strap into the aperture in the chamber in the second direction.

3. A seal according to claim 2, wherein the insertion preventing arrangement comprise angled teeth.

4. A seal according to claim 1, wherein each of the overlapping apertured members extend essentially normally to the direction in which the strap passes through the clip.

5. A seal according to claims 1, wherein the overlapping apertured members are configured to normally assume positions wherein the apertures therein are out of register and which are forced to positions wherein the apertures are in register by the passage of a frusto-conical shaped serration on the strap through the apertures.

* * * * *